US005101561A

United States Patent [19]

Fuhrmann et al.

[11] Patent Number: 5,101,561

[45] Date of Patent: Apr. 7, 1992

[54] HEAT EXCHANGER AND A METHOD FOR A LIQUID-TIGHT MOUNTING OF AN END PLATE TO AN ARRAY HEAT EXCHANGING ELEMENTS OF THE HEAT EXCHANGER

[75] Inventors: Ernst Fuhrmann, Espenau; Michael Kozica, Immenhausen, both of Fed. Rep. of Germany

[73] Assignee: Autokühler GmbH & Co. KG, Hofgeismar, Fed. Rep. of Germany

[21] Appl. No.: 493,465

[22] Filed: Mar. 14, 1990

[51] Int. Cl.[5] ..... B21D 53/08; F28F 9/16

[52] U.S. Cl. ..... 29/890.043; 29/890.044; 165/151; 165/173

[58] Field of Search ..... 165/151, 173, 175; 29/890.043, 890.044, 890.046

[56] References Cited

U.S. PATENT DOCUMENTS

| | | | |
|---|---|---|---|
| 2,573,161 | 10/1951 | Tadewald | 29/890.043 |
| 3,972,371 | 8/1976 | Plegat | 29/890.043 |
| 4,456,059 | 6/1984 | Cadars | 165/173 |
| 4,467,511 | 8/1984 | Collgon | 29/890.043 |
| 4,570,317 | 2/1986 | Veling et al. | 29/890.046 |
| 4,574,444 | 3/1986 | Humpolik | 29/890.043 |
| 4,692,979 | 9/1987 | Pietzcker | 29/890.046 |
| 4,720,902 | 1/1988 | Gray | 29/890.044 |
| 4,730,669 | 3/1988 | Beasley et al. | 165/173 |
| 4,739,828 | 4/1988 | Bayer et al. | 165/173 |
| 4,766,667 | 8/1988 | Gray | 29/890.044 |
| 4,799,540 | 1/1989 | Pietzcker | 165/151 |

FOREIGN PATENT DOCUMENTS

| | | |
|---|---|---|
| 0176729 | 4/1986 | European Pat. Off. . |
| 1751710 | 12/1971 | Fed. Rep. of Germany . |
| 2747275 | 4/1979 | Fed. Rep. of Germany . |
| 3505492 | 8/1986 | Fed. Rep. of Germany . |
| 2474674 | 7/1981 | France . |
| 2475709 | 8/1981 | France . |
| 2567247 | 1/1986 | France . |
| 29994 | 2/1984 | Japan . |
| 2055064 | 2/1981 | United Kingdom . |

*Primary Examiner*—John Rivell
*Assistant Examiner*—L. R. Leo
*Attorney, Agent, or Firm*—Michael J. Striker

[57] ABSTRACT

Disclosed is a heat exchanger assembled of a plurality of oval heat exchanging pipes whose end portions are mounted in a leakage proof manner in oval openings of top and bottom plates. The ratio of maximum and minimum diameters of intermediate portions of the pipes if 2.5:1 through 8:1 whereas the ratio of the maximum and minimum diameters of the oval openings in the end plates is 1.2:1 through 3:1. A method of mounting the pipe end portions in the oval openings is based on a preliminary shaping of the end portions by the application of pressure from the outside toward the center axis of the end portions in the direction of their maximum diameter. The preshaped end portions are inserted into sealing collars surrounding the edges of respective plate openings. Thereafter the end portions are expanded by means of mandrels to sealingly close the openings.

6 Claims, 6 Drawing Sheets

Fig.7A
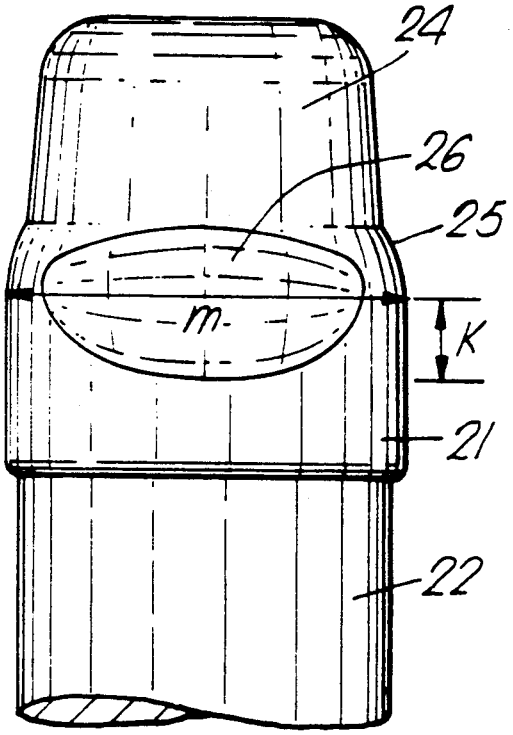
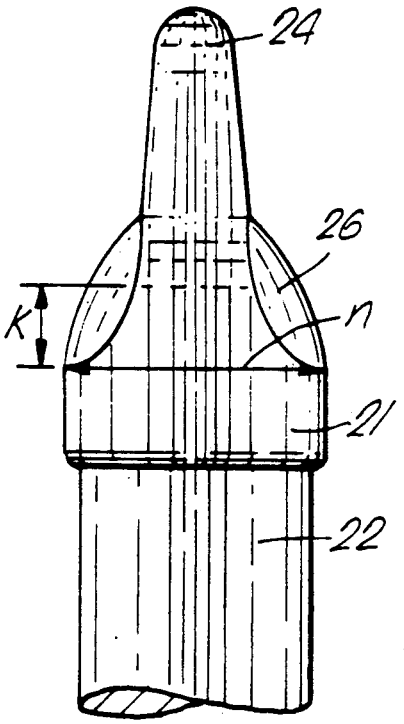
Fig.7B
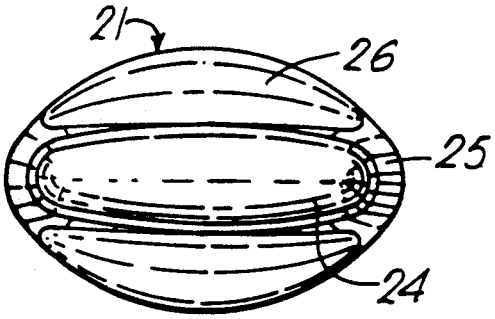
Fig.7C

HEAT EXCHANGER AND A METHOD FOR A LIQUID-TIGHT MOUNTING OF AN END PLATE TO AN ARRAY HEAT EXCHANGING ELEMENTS OF THE HEAT EXCHANGER

BACKGROUND OF THE INVENTION

The present invention relates to a heat exchanger having a network of heat exchanging elements which includes a plurality of pipes of oval cross-section and end plates provided with a plurality of openings for receiving end portions of the oval pipes, a plurality of sealing elements arranged in the openings and the end plates being attached to the end portions by expanding the end portions of the oval pipes. The invention also relates to a method for liquid-tight mounting of at least one end plate to the network of heat exchanging elements.

The mounting of heat exchanging networks on end plates of a heat exchanger, such as used for example in a motor vehicle radiator still involves problems when the pipes of the heat exchanging network have an oval cross-section and are supposed to be secured to the end plates by expanding their end portions only, that means without the use of any soldering, cementing and the like. Inasmuch the end plates serve for supporting a collecting vessel which accumulates the cooling medium flowing through the pipes of the heat exchanger, the mounting of the end plate must be not only liquid-tight or gas-tight but also mechanically stable to such an extent that the unavoidable shaking or vibrations resulting during the use of the heat exchanger do not impair the mount and can withstand the hydraulic pressure of the cooling medium. This condition, particularly when using oval pipes as heat exchanging elements cannot be always met because the ratio of diameters of the oval pipes that means the ratio of the maximum outer diameter to the minimum outer diameter is greater than about 2.5:1. In heat exchanging pipes of this kind, the fastening of long pipe wall portions extending substantially parallel or in the direction of the maximum diameter, in the elastic sealing collars of the end wall, was frequently insufficiently strong. In spite of the expansion of the end portions of the pipe there is still the risk that the pipe wall portions extending parallel or in the direction of the miminum pipe diameter collapse and thus preclude a reliable seal or a mechanically stable connection.

The prior art heat exchanger of this kind (DE-OS 27 47 275), therefore have reinforced long sides of the heat exchanging pipes, by providing for example wall portions of greater thickness or annular inserts or a stepwise enlargement. Such conventional measures however have proved as unsatisfactory for a mass production.

For avoiding this disadvantage a heat exchanger has been proposed (DE-PS 1,751,710) wherein the bottom end plate is provided with circular cutouts or openings for receiving sealing elements also of a circular cross-section and the throughgoing oval end portions of the heat exchanging pipes have been expanded to form a cylindrical or cone configuration. By this measure the risk of collapsing is practically eliminated. Of course, it must be taken into account that such prior art heat exchanger and the corresponding method for mounting the heat exchanging pipes is suitable only for oval pipes having the diameter ratio approximately 2:1. When using the ratio of maximum to the minimum diameter of 2.5:1 and more, as required for heavy duty motor vehicle radiators and the like, such expansion of end portions of the pipes results in excessively long transition zones between the pipe portion having a circular cross-section and the pipe portion having an oval cross-section. This brings about the danger that the pipes themselves or the sheet metal fins drawn thereon crack or rupture or the immediately adjoining sheet metal fin is shifted and thus the cooling efficiency is decreased. In addition the use of cylindrical end portions of the heat exchanging pipes in a series of side-by-side arranged heat exchanging networks necessitate substantially increased spacing between the pipes in comparison with oval configuration of the end portions and consequently a corresponding reduction of efficiency of heat exchanging network in a heat exchanger of the same size would result. Such substantial disadvantages can be only insignificantly reduced by using heat exchanging pipes of an increased maximum diameter corresponding to the diameter of the sealing collar, and shaping the end portions of the pipe first by means of an inserted expansion mandrel and the like in such a manner that the maximum diameter is reduced and the minimum diameter is increased to provide the cylindrical cross-sections in the end portions which are slightly smaller in diameter than the sealing collars. Even this mounting procedure results in large transition zones between the ranges of oval and circular cross-sections, thus exhibiting again the above mentioned problems.

SUMMARY OF THE INVENTION

It is therefore an object of the present invention to provide a heat exchanger of the above described type which enables a liquid-tight and a mechanically stable fixing of oval end portions of the heat exchanging pipes having a relatively large ratio of their diameters, for example 2.5:1 through 8:1, without the need of soldering or cementing.

Another object of this invention is to provide a method for mounting the expanded end portions of the heat exchanging pipes in an end plate wherein the risk of damage of the pipe and/or of the guiding metal sheet and/or of the sealing collar is eliminated.

In keeping with these objects and others which will become apparent hereafter, one feature of the invention resides in providing at least one end plate with oval openings for receiving the oval heat exchanging pipes, the ratio of the maximum and minimum diameters of the respective pipes being 2.5:1 through 8:1, and the ratio of the maximum and minimum diameters of the expanded end portions of the pipes being 1.2:1 through 3:1.

The method of this invention resides in the steps of placing into respective oval openings a plurality of sealing collars each enclosing a sealing element, a central passage of respective sealing elements receiving the end portions of the heat exchanging pipes, the end portions being expanded in all directions transverse to the longitudinal axis of the pipes to provide a liquid-tight seal, whereby prior to the expansion the larger diameter of the end portions the larger diameter thereof is reduced and the smaller diameter thereof is increased by applying a pressure from the outside inwardly.

The invention brings about the unexpected advantage that only by selecting the dimensions of the cross-sections of pipes in the range of their end portions permanent good connections between the end plates and the end portions of the heat exchanger are obtained even then when the oval pipes have relatively large ratio of their maximum and minimum diameters namely between 2.5:1 and 8:1 and the end portions preserve their oval form. With these ratios of maximum and minimum diameters the clamping of the end portions of the pipes in the sealing collars is sufficient for all practical applications even if made by a mass production and the end portions preserve their oval shape. In this manner it is made possible to design a heat exchanger assembled of one or more arrays or series of heat exchanging pipes having a high density of pipes per unit area, a high ratio of maximum and minimum diameters and a reliable liquid-proof mounting to the end plates. With regards the method of this invention it has the advantage that the mounting process of the end portions of the pipes in the openings of the end plate is very safe against damage so that even if using large ratios of the maximum and minimum diameters there is no risk of damaging the pipe or the conductive metal sheet fins attached thereto.

The invention will be explained in the description of a preferred exemplary embodiment when read in connection with the accompanying drawing.

DESCRIPTION OF THE PREFERRED EMBODIMENT

Figure 1:
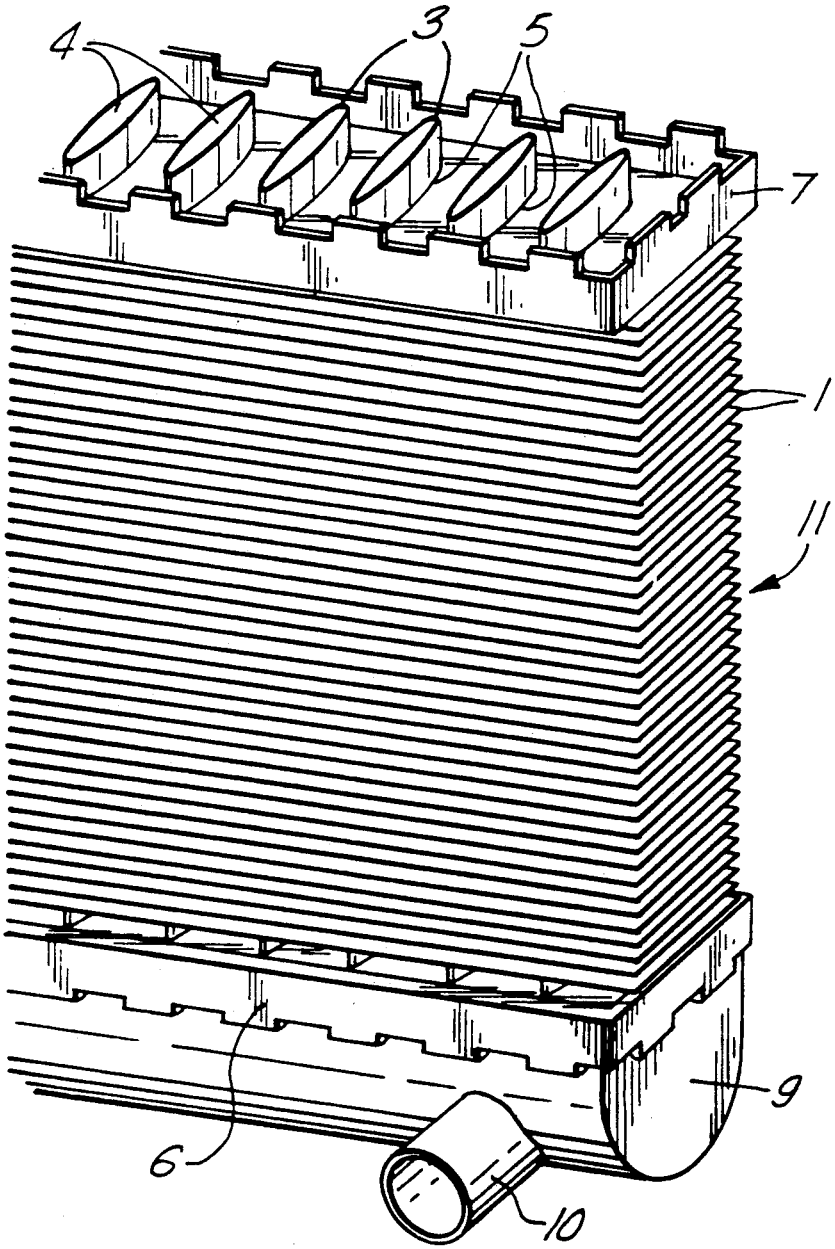
FIG. 1 is a perspective view of a heat exchanger having a series of oval heat exchanging pipes.
Figure 4:
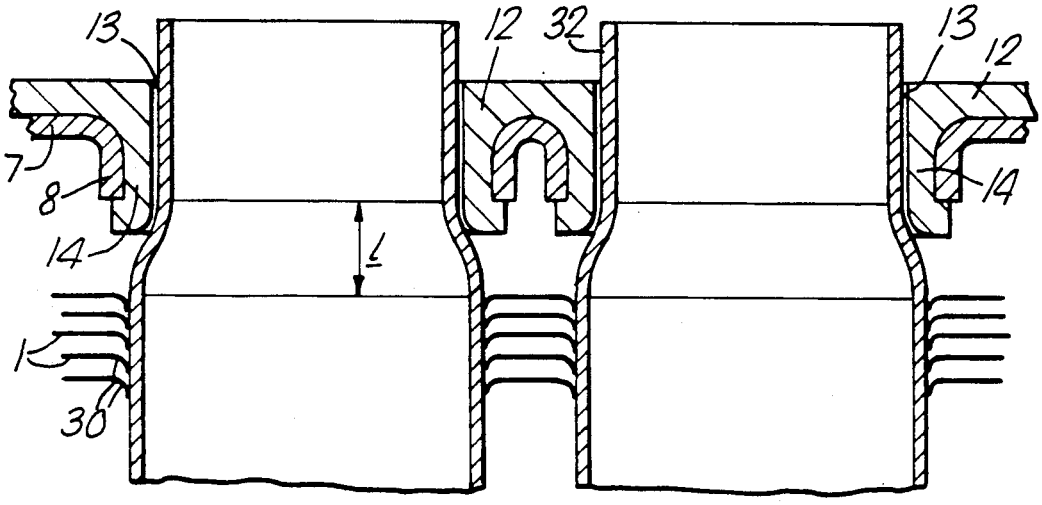
FIG. 4 is a sectional side view taken along the line IV—IV of FIG. 2, after the pressing jaws have been removed and shaped end portions of the pipes have been inserted into the openings in an end plate.
Figure 5:
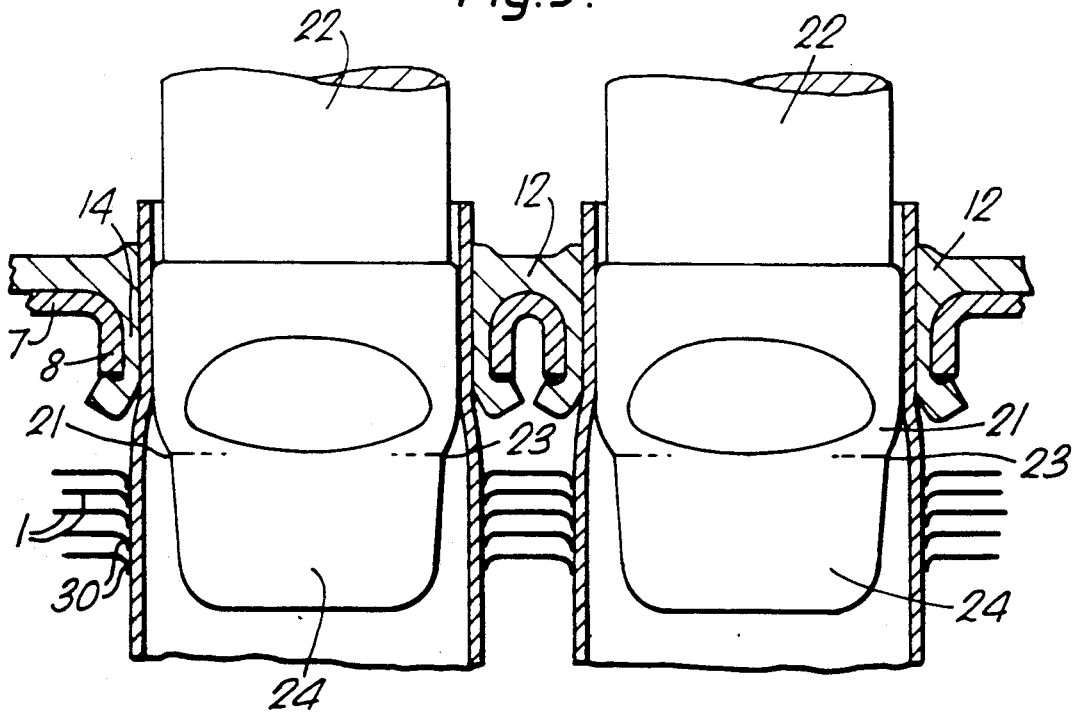
FIG. 5 is a view similar to FIG. 4 showing the insertion of tapered plugs or mandrels for expanding the shaped end portions of the pipes in the end plate.

FIG. 1 illustrated a heat exchanger having a single row of heat exchanging elements assembled in accordance with conventional pipe radiators. It includes a plurality of parallel sheet metal fins 1 stacked at a distance one above each other and each being formed with a series of oval openings which in the stack of the conductive metal fins 1 are in alignment so as to receive corresponding heat exchanging pipes 3. The edges of the openings in the conductive metal fins 1 are provided with collars 30 of a cross-section corresponding to the oval cross-section of the pipes 3 (FIGS. 4 and 5). The upper and lower end portions of respective pipes 3 project through openings 5 in the bottom end plate 6 and in the top end plate 7. As illustrated in FIGS. 4 and 5, the edges of the openings 5 are also bent to form peripheral collars 8 serving for attaching sealing means as it will be explained later on. A conventional cooling fluid collecting vessel 9 is attached to the bottom end plate 6; a connection piece 10 serves for feeding a liquid medium such as cooling water flowing through the pipes 3 into and from the collecting vessel 9. A corresponding, non-illustrated storage tank or collecting vessel is connected to the top end plate 7. The conductive metal fins 1 can be also provided with conventional arrays of gills for whirling a second cooling medium, such as air.

Figure 2:
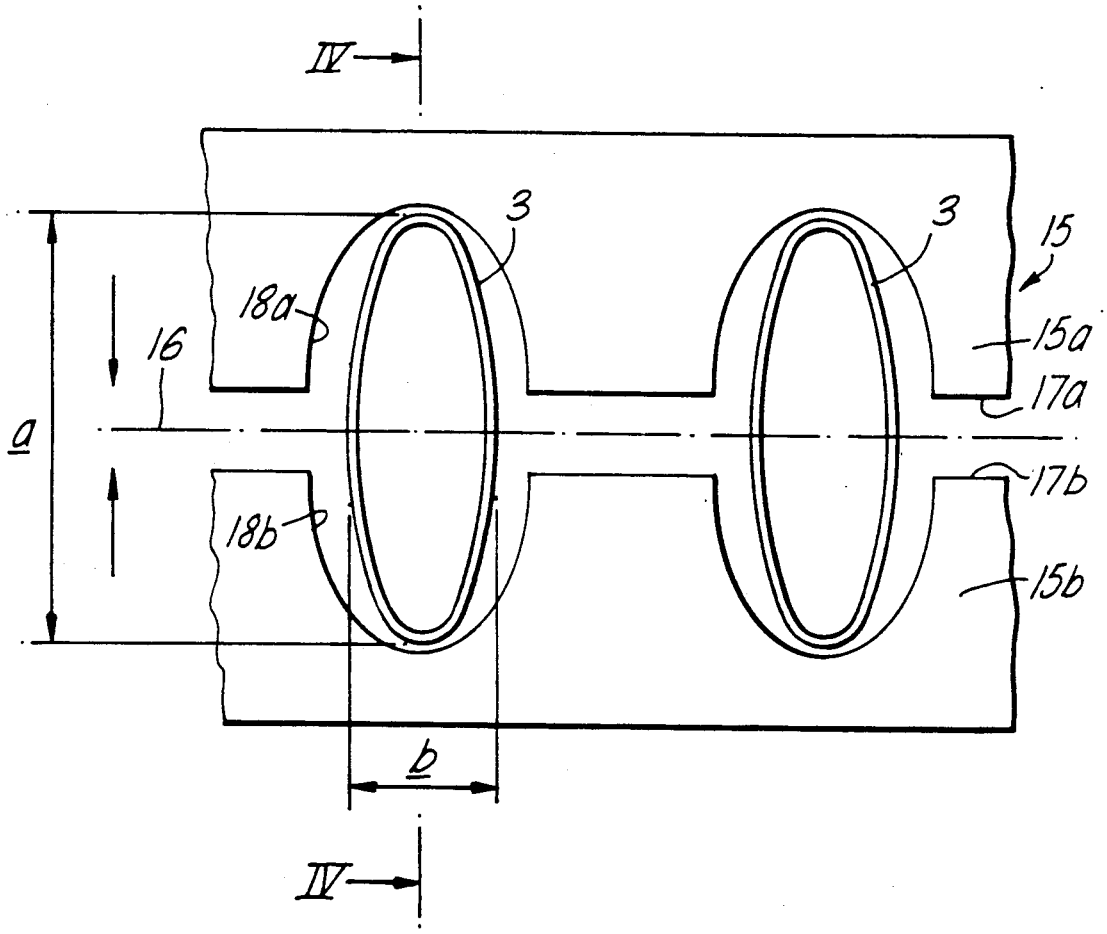
FIG. 2 is a top plan view of a portion of the heat exchanger of FIG. 1 showing on an enlarged scale the ends of the oval pipes together with applied pressing jaws shown in their released position.
Figure 3:
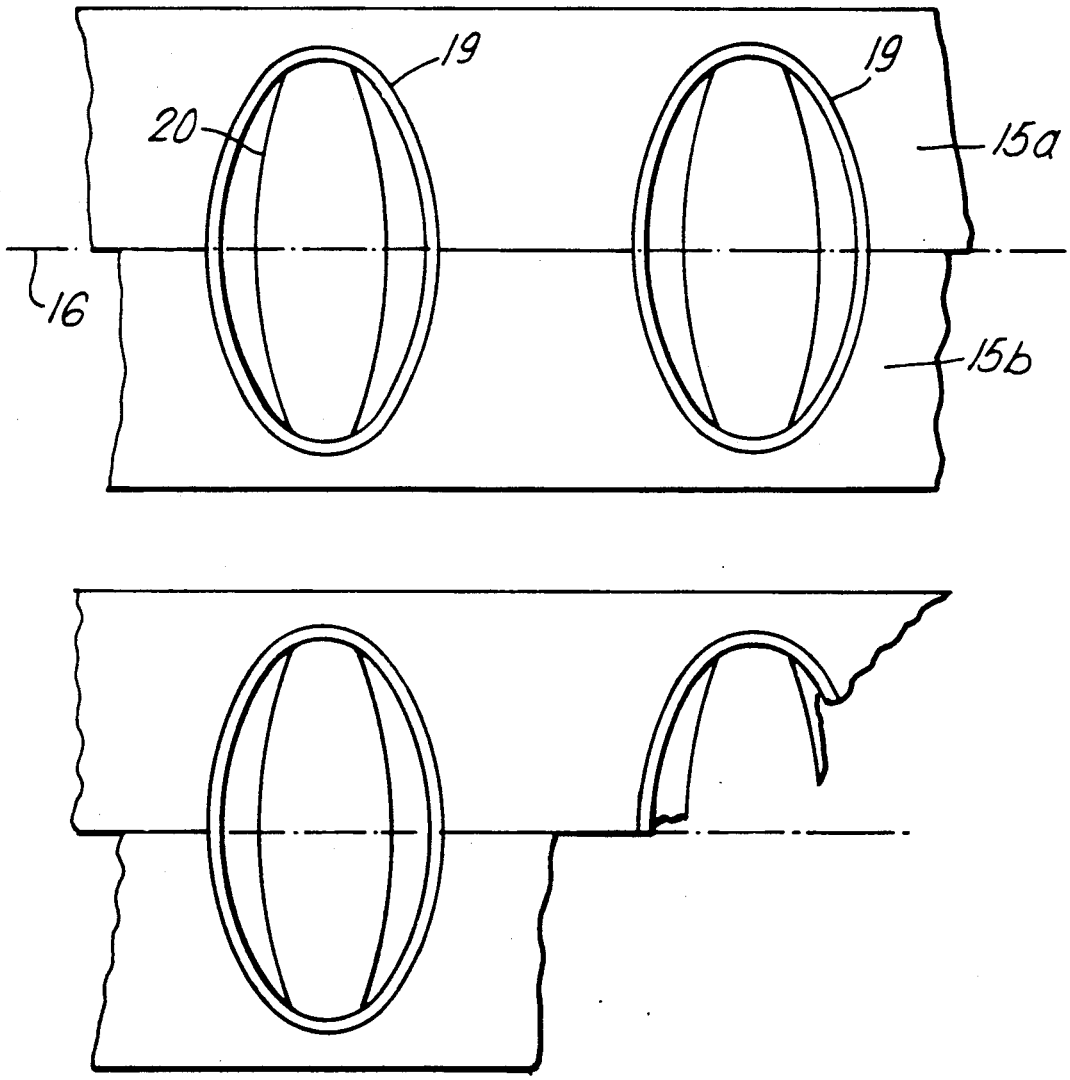
FIG. 3 is a view similar to FIG. 2 showing two rows or series of oval pipes after shaping their end portions by the pressing jaws shown in their closed position.

Referring to FIG. 2, each oval heat exchanging pipe 3 defines a maximum outer diameter a, in the following "a large diameter" which is about 2.5 through 8 times larger than the minimum outer diameter b in the following "a small diameter" so that the ratio of the large to small diameters is 2.5:1 through 8:1. As indicated in FIG. 3, the heat exchanger can be assembled of a plurality of parallel rows or series of heat exchanging pipes arranged side-by-side in alignment with their small diameters b.

In this exemplary embodiment it is assumed that the large diameter a is 12.4 mm and the small diameter b is 3.6 mm and that the wall thickness of the pipes is 0.4 mm. Further it is assumed that the pipes 3 are firmly connected to the conducting metal fins 1, thus forming therewith a so-called heat exchanging network 11 (FIG. 1) This interconnection is achieved in conventional manner, known for example from the manufacturing of oil or water cooled radiators for motor vehicles.

To connect the heat exchanging network 11 with the end plates 6 or 7, it is proceeded in accordance with the below described method of this invention. Since either end plate 6 and 7 is secured to the heat exchanging pipes 3 in the same manner, in the following description only the attachment of the top end plate 7 will be described.

In this embodiment the end plate 7 is formed with a plurality of oval cutouts or openings 5 whose maximum inner diameter is 13.2 mm and whose minimum inner diameter is 8.7 mm. The same dimensions are valid for the diameters of the collars 8. The top end plate 7 is further provided with sealing elements 12 (FIGS. 4 and 5) each defining a sealing collar 14 surrounding an assigned collar 8 of the openings and delimiting a throughgoing passage 13 for receiving an end portion of the pipe. The sealing element 12 if desired can be connected to a sealing mat or plate extending over the width and length of the top end plate 7. The sealing plate is loosely laid on the surface of the end plate so that the sealing collars 14 project into the collars 8 of the plate 7 and firmly engage the inner surface of the collars 8. In a modification, the sealing elements 12 can be applied by spraying and firmly connected to the end plate 7 by vulcanization (DE-OS 35 05 492). The sealing elements 12 are made of a sufficiently elastic material, for example of an elastomer. In this example, throughgoing passages 13 of the sealing collars 14 have a maximum inner diameter of 11.3 mm and a minimum inner diameter of 6.8 mm.

Prior to the insertion of the pipes 3 into the sealing collars 14, the end portions of the pipes 3 are shaped by the application of pressure from the outside toward the center axis of the end portions in such a manner that the large diameter a is reduced to 11.1 mm and the small diameter b is increased to 6.6 mm. For this preshaping process a pressing tool 15 illustrated in FIG. 2 is employed. The pressing tool consists of two plate-shaped pressing or shaping jaws 15*a* and 15*b* which extend from opposite sides along an axis 16 coinciding with the minimum diameters of the oval pipes 3 arranged in a row. The pressing jaws 15*a* and 15*b* have abutment surfaces 17*a* and 17*b* extending parallel to the axis 16, and opposite shaping recesses 18*a* and 18*b* provided between the respective abutment surfaces or edges 17*a* and 17*b*. The recesses 18*a* and 18*b* have a semi-oval cross-section to delimit in the closed position of the pressing tool 15 illustrated in FIG. 3 a closed oval outline 19 whose maximum inner diameter is normal to the axis 16 and whose minimum inner diameter coincides with the axis 16. The spacing between the respective shaping recesses 18*a* and 18*b* in the direction parallel to the axis 16 corresponds to the spacing between the pipes 3 in a row or series. The closed oval outline 19 in this example has a maximum diameter 11.1 mm the minimum diameter 6.6 mm. The thickness of the plate-shaped pressing jaws 15*a* and 15*b* is preferably so large as is the length of the sealing collars 14 plus a distance of the end portion of the pipe which projects above the sealing elements 12 when viewed in the axial direction of the pipes. The overlapping length of the end portions serves for neutralizing longitudinal and angular tolerances of the pipes and of the end plates. In addition, the width of the pressing tool also includes a transition range of a length l (FIG. 4) corresponding to the transitory region between the prepressed end portions of the pipes and the oval cross-section of the unchanged parts of the pipe in the network.

The pressing jaws 15*a* and 15*b*, as seen from FIGS. 2 and 3, are applied against the upper surface of the end portions of the heat exchanging pipes 3. The two pressing jaws are then compressed one against the other by means of a non-illustrated mechanical, pneumatic, hydraulic or electrical device in the direction of arrows (FIG. 2) until the abutment surface portions 17*a* and 17*b* contact each other whereupon the pressure is released by moving the jaws in the direction opposite to the arrows. As a result, the end portions are preshaped from the outside to the shape of the oval contours 19 of the pressing jaws (FIG. 3) such that the large diameter of the end portions is reduced to 11.1 mm and the small diameter is increased to 6.6 mm. Accordingly, the end portions of the pipes have a cross-section which permits the insertion into the sealing collars 14 which was not possible prior to the prepressing step. Line 20 in FIG. 3 indicates the outline of the end portions in their original condition prior to their preshaping; the line 20 also corresponds to the outline of the remaining unshaped part of the pipes 3 which are partially visible in the plan view of the end portions.

If the exchanging networks contain several rows of heat exchanging pipes 3 as it is schematically indicated in FIG. 3, the end portions of the remaining pipe rows are preshaped in the same fashion whereby the individual rows are preferably treated one after the other with the same pressing tool 15.

In the subsequent step the end plate 7 provided with the sealing elements 12 is laid on the preshaped end portions of the network of heat exchanging pipes as shown on an enlarged scale in FIG. 4. It is evident that the preshaping enables the insertion of the end portions into the free spaces delimited by the sealing collars 14. In reality the free space amounts for example to only one to two tenth of a millimeter. The top end plate 7 of course has been provided with the corresponding number of rows of cutouts or openings 5.

The final fastening of the end plate 7 to the heat exchanging network 11 is effected such that the end portions are expanded in a conventional manner by means of tapered plug or mandrel 21. For this purpose a number of mandrels 21 is inserted into the corresponding number of pipe end portions and are connected via supporting elements 22 to a common driving device. According to FIG. 5, each mandrel 21 has an oval outer cross-section connected via sloping surfaces 23 with a tip region 24 of smaller diameter which is first inserted into the pipe end portion. In this example the outer diameter of the mandrel 21 is selected such that the pipe end portions are expanded through a single insertion of the mandrel 21 to match their outer outline defining a large diameter of 12 mm and a small diameter of 7.9 mm. Due to the expansion, the elastic walls of the sealing collar 14 are expanded in the direction of its large diameter by 0.35 mm and in the direction of its small diameter by 0.55 mm, that means the pipe end portions are more strongly shaped in the direction of their small diameters.

Inasmuch as when using heat exchanging pipes dimensioned in accordance with this example the danger is present that the pipe end portions during their tulip-shaped expansion by means of the mandrel 21 might crack, it is preferred to perform the expansion in two steps whereby each of the steps includes two processing stages.

In the first expanding step the mandrels 21 according to FIG. 7 are used whose large diameter m and small diameter n are for example 0.6 mm smaller than the diameters of final inner cross-sections of the pipe end portions. In the second expanding step are again used the mandrels 21 of FIG. 7 whose diameters m and n correspond to the final dimensions of the pipe sections. An advantage of this measure in comparison with the shaping by means of a single step is in the more gentle treatment of the end portions resulting in the greatly reduced possibility of cracking the pipes.

It is also of particular advantage when each of the two steps is performed in two stages whereby the pipe end portions are first gradually expanded over the large diameter and then while maintaining the resulting value of the large diameter, are gradually expanded over the small diameter that means transversely to the long sides of the pipes. This procedure has an advantage in comparison with the gradual simultaneous expansion of the end portions in all directions in that the shaping of the particularly crack susceptible portions of the pipe having small radius of curvature are protected by allowing the influx of material from the adjoining pipe portions of a larger radius of curvature, since the latter portions at time point of shaping are not yet brought in contact with the flanks of the mandrel and therefore are not yet frictionally attached to the latter.

According to FIGS. 7*a* through 7*c* the tip 24 of the mandrels 21 is shaped to form a knife-like edge so that the pipe in the transision region between the end portion and the intermediate pipe portion does not collapse due to compressive strain and does not diminishes its diameter in this range. Such an upsetting of the pipe 3 might appear during the sliding travel of the mandrel and the resulting thrust in the longitudinal direction of the pipe 3. In particular, the tip 24 is shaped such that its small diameter is somewhat shorter than the small inner diameter of the intermediate portion of the heat exchanging pipe, and its large diameter is somewhat smaller than the large inner diameter of the pipe end portions after the compressing. In this manner it is guaranteed that the long side walls of the pipes 3 contact the tip 24 and are supported thereon only then when they have actually buckled out inwardly.

As seen from FIG. 7*a*, the tip portion 24 is connected with an intermediate mandrel section 25 extended in the feeding direction of the mandrel to provide the above explained first expansion stage in the direction of the large diameter to a preselected value; the large diameter of the intermediate portion 25 gradually increases from the tip portion outwardly up to the value m of the large diameter whereupon up to the end of the mandrel it remains substantially constant. The intermediate mandrel portion 25 is connected—when viewed in the feeding direction of the mandrel—to receiving mandrel portion 26 which performs the aforedescribed second expanding stage in the direction of the small diameter to a preselected value. The smaller diameter of the receiving portion 26 has a gradually increasing value when viewed from the beginning of the mandrel portion 25 to reach the value n of the small diameter (FIG. 7*b*) whereupon it remains substantially constant up to the end of the mandrel. As seen in FIGS. 7*a* and 7*b*, difference k denotes the distance at which, when viewed in the feeding direction of the mandrel 21, the large diameter m is completed ahead of the small diameter n. The two portions 25 and 26 of the mandrel can be arranged one after the other in such a manner that the expansion in the direction of the small diameter starts only after the expansion in the direction of the large diameter is completed. It is also possible to offset the two mandrel sections 25 and 26 one from the other and to make them partially overlapped so that the expansion parallel to the small diameter starts before the expansion parallel to the large diameter is fully completed.

Figure 6:
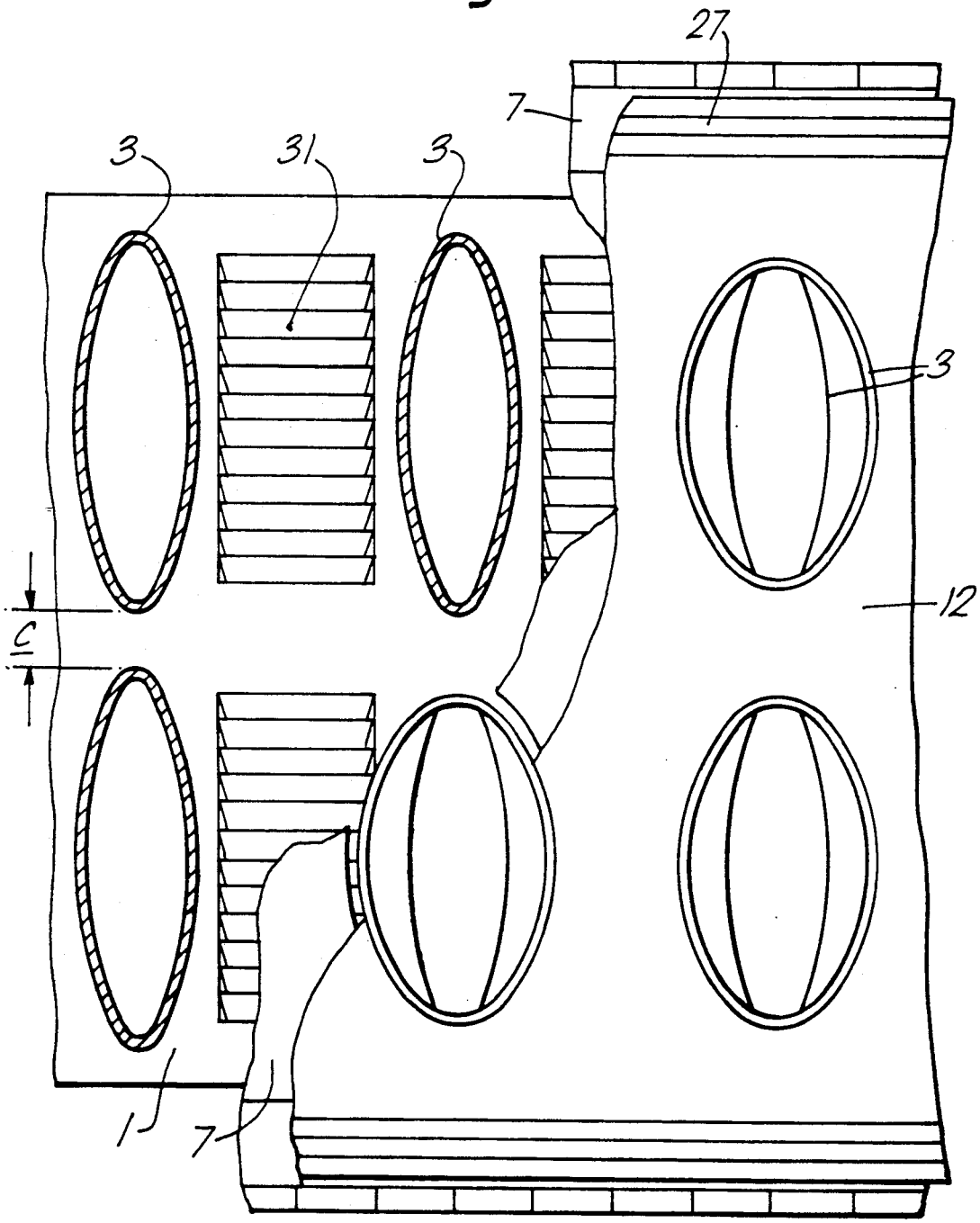
FIG. 6 is a top plan view of partly cut-away portions of the heat exchanging network after the end portions of respective oval pipes have been secured to the end plate; and FIG. *7a* shows an elevation view, *7b* a side view and *7c* a plan view of the shaping mandrel of FIG. 5, illustrated on an enlarged scale.

As indicated in FIG. 6, the end portions of pipes 3 are permanently and firmly connected with the end plate 7. Subsequently the completed heat exchanging network 11 is connected in conventional manner with the lid of an assigned cooling liquid collecting vessel whose peripheral rim is inserted for example in a corresponding peripheral groove 27 provided with a sealing agent; subsequently the vessel is fastened to the plate 7 by bending its clamping prongs. In the case of end plates 6 and 7 and the covers of the collecting vessels made of a plastic material the connection may be made for example by means of vibration welding, glueing and the like.

As mentioned before, in this exemplary embodiment the original ratio of diameters of the pipe 3 (12.4:3.6=3.44) is first changed by means of the pressing jaws 15*a* and 15*b* to 11.1:6.6=1.68 and then by expansion through the mandrels 21 is changed to 12:7.9=1.52 to smaller values. A particular advantage of the preshaping by means of pressure being applied from outside on the outer surfaces of the pipe end portions is to be seen in the fact that even if the pipes 3 have been shaped the circumference is substantially unchanged. Therefore the shaping process takes place without stretching the pipe walls and without the so-called stiffening of participating layers of material resulting from such a stretching; therefore during the final expansion of the end portions there is no risk of cracking of the pipe walls or of the collars. The expansion can be also performed in such a manner that the sealing collars 14 are prestressed uniformly in all radial directions, that means substantially radially to a center axis of the pipes and if desired also in a preferred direction, for example parallel to the small diameters provided that such a prestressing is advantageous for individually employed sealing collars.

Another substantial advantage of the method of this invention is to be seen in the fact that the large diameter of the pipe can be larger than the large diameter of the end portions after their expansion. As a result it is possible to produce compact, narrow heat exchangers wherein the minimum spacing between the walls of pipes 3 in heat exchanging networks (dimension c in FIG. 6) in the direction of the large diameter is smaller than the corresponding spacing of the inner walls of the sealing collars after the insertion of the latter into the collars of the end plate. For this reason the method of this invention is suitable primarily for connecting the heat exchanging network with end plates of metal wherein this spacing, in contrast to end plates made of plastic, is limited for manufacturing reasons. Still another essential advantage of this invention is in the fact that the expansion of the end portions can proceed without gradation and therefore the pipe end portion does not become overloaded.

It will be understood that this invention is not limited to the details of this exemplary embodiment but can be modified without departing from the spirit of this invention. For example the exemplary ratio of the diameters of the pipe in the heat exchanger of this invention can be varied within broad limits. For example ratio of diameters preferably of 2.5:1 through 5:1 but also 5:1 through 8:1 for the oval pipes 3 of the heat exchanging network, and ratios of 1.2:1 through 3:1 for the pipe end portions in a completed heat exchanger have been proved particularly suitable. It is also conceivable to make the preshaping of cross-section of the pipe end portions to match the cross-section of the sealing collars by applying pressure from the interior outwardly as long as only the preshaping of a substantially constant periphery is desired. Furthermore, it is not necessary to perform the preshaping such that the modified cross-section of the pipe end portions is exactly oval since other configurations of the cross-section for example rhombic cross-sections or the like may provide comparable results. In addition, it is also possible during the shaping process to introduce a mandrel into the pipe end portion which during the shaping acts as an inner abutment support for the pipe walls. Furthermore, the invention is not limited to the use of end plates provided with the plate collars 8. Especially when using end plates of plastic the collars 8 can be completely dispensed with. By a suitable selection of the wall thickness of the plastic end plates it is insured that the inner surface of the cutouts or openings in the end plates are sufficient for reliably holding via the sealing elements 12 and the sealing collars 14 the pipes in the end plate openings. If desired, the inner surface of the plate openings can have also a stepped configuration. Another advantage of end plates of plastic material resides in that for manufacturing and technological reasons (production of end plates by injection molding without drawing the plate collars) the spacing between pipe rows and thus the depth of the heat exchanging network can be made still smaller than when using end plates of metal.

The invention is not limited to oval pipe cross-sections in a strictly mathematical sense. Under the term "oval" for the purposes of this invention are to be understood all approximately oval or elliptical or eggs-shaped and the like cross-sections defining for example two parallel straight opposite sides whose ends are connected by oval, elliptic, semi-circular and the like curved end portions. Also the pipes having such modified cross-sections should define the ratio of the large diameter to the small diameter amounting between 2.5:1 through 8:1.

What is claimed as new and desired to be protected by Letters Patent is set forth in the appended claims:

1. A method of liquid-tight mounting of an end plate to a plurality of heat exchanging tubes having substantially oval cross-sections having first maximum diameters, first minimum diameters, and first ratios of the first maximum diameters to the first minimum diameters of 2.5:1 to 8:1, said method comprising the steps of providing the end plate with a plurality of openings for receiving the heat exchanging tubes; providing a plurality of sealing elements extending into said plurality of openings and defining elastically deformable and substantially oval passages having in an undeformed condition of said sealing elements second maximum diameters and second minimum diameters; preshaping end portions of the heat exchanging tubes by applying outer pressure to the end portions in a direction of the first maximum diameters to reduce the first maximum diameter to a third maximum diameter and to increase the first minimum diameter to a third minimum diameter at the end portions without substantial change of the circumferences of said end portions and such that said end portions can be inserted into said passages without substantial stress and force; thereafter inserting the end portions of the heat exchanging tubes into the elastically deformable passages of said plurality of sealing elements; and then providing liquid-tight and mechanically stable connections of the end portions of said heat exchanging tubes with the end plate by expanding the end portions and said sealing elements in all directions from inside thereof in such a way that its cross-sections substantially remain oval, have fourth maximum diameters greater than said second maximum diameters and fourth minimum diameters greater than said second minimum diameters, and have second ratios of the fourth maximum diameters to the fourth minimum diameters of 1.2:1 through 3:1, the first ratios being always larger than the second ratios.

2. A method as defined in claim 1, wherein said step of providing a plurality of sealing elements comprises the steps of providing a plurality of sealing elements having collars defining elastically deformable oval passages and of inserting said sealing elements into said openings, and said preshaping step includes preforming the end portions of the heat exchanging tubes in such a manner that the end portions have substantially oval cross-sections that are smaller by a minute clearance when compared with cross-sections of the elastically deformable oval passages defined by the collars of the sealing elements.

3. A method as defined in claim 1, wherein said expanding step is performed in two steps.

4. A method as defined in claim 3, wherein each of said two steps is performed in two stages in such a manner that expansion in a direction of the fourth maximum diameters is completed before expansion in a direction of the fourth minimum diameters.

5. A method as defined in claim 3, wherein said expanding step includes the step of providing mandrels for each of said two steps axially insertable into said end portions and having leading regions for producing predetermined fourth maximum diameters of the end portions and trailing regions for producing predetermined fourth minimum diameters of the end portions.

6. A method as defined in claim 5, wherein said mandrel providing step includes providing mandrels having an edge-like projecting tip portion for preventing deformation of transition regions between the end portions and intermediate portions of the heat exchanging tubes.

* * * * *